US008122730B2

(12) United States Patent
Scrivener et al.

(10) Patent No.: US 8,122,730 B2
(45) Date of Patent: Feb. 28, 2012

(54) METHOD AND DEVICE FOR MANAGING THE OPERATING CONDITIONS OF A REFRIGERATOR COMPARTMENT USING A SINGLE SENSOR

(75) Inventors: Arthur Wilson Scrivener, Louisville, KY (US); Joshua Blake Huff, Louisville, KY (US)

(73) Assignee: General Electric Company, Schenectady, NY (US)

( * ) Notice: Subject to any disclaimer, the term of this patent is extended or adjusted under 35 U.S.C. 154(b) by 492 days.

(21) Appl. No.: 12/339,190

(22) Filed: Dec. 19, 2008

(65) Prior Publication Data

US 2010/0161152 A1 Jun. 24, 2010

(51) Int. Cl.
*F25B 49/00* (2006.01)
*G01K 13/00* (2006.01)
*G05D 23/00* (2006.01)

(52) U.S. Cl. ..... 62/126; 62/129; 700/299

(58) Field of Classification Search ..... 62/126, 62/129, 157, 498; 700/299
See application file for complete search history.

(56) References Cited

U.S. PATENT DOCUMENTS

| | | | | |
|---|---|---|---|---|
| 5,927,078 | A * | 7/1999 | Watanabe et al. | 62/3.6 |
| 6,116,036 | A | 9/2000 | Canavesi et al. | |
| 7,337,620 | B2 | 3/2008 | Coulter et al. | |
| 2007/0012055 | A1 | 1/2007 | Schenk et al. | |
| 2007/0089434 | A1 * | 4/2007 | Singh et al. | 62/129 |

FOREIGN PATENT DOCUMENTS

| | | | |
|---|---|---|---|
| JP | 06327985 | A * | 11/1994 |
| JP | 2008039197 | A * | 2/2008 |

* cited by examiner

*Primary Examiner* — Chen Wen Jiang
(74) *Attorney, Agent, or Firm* — Global Patent Operation; Douglas D. Zhang

(57) ABSTRACT

A method and device for managing the operating conditions of a refrigerator unit using a single sensor are disclosed. The method includes the steps of determining a sensor temperature of a refrigerator unit, determining to which a plurality of disjoint temperatures regions the temperature lies within and setting an operating condition of each of a plurality of components of the refrigerator unit based on the determined temperature region.

18 Claims, 4 Drawing Sheets

METHOD AND DEVICE FOR MANAGING THE OPERATING CONDITIONS OF A REFRIGERATOR COMPARTMENT USING A SINGLE SENSOR

BACKGROUND OF THE INVENTION

Current refrigerator designs include a plurality of mechanisms for the control of different functions. For example, one mechanism controls the temperature of the refrigerator unit while a second mechanism controls the temperature of the freezer unit. In addition, there are mechanisms for the control of through-the-door ice and water dispensing and freezer defrosting cycling.

However, each of these mechanisms has been developed at different times and operates essentially independently. This results in inefficient operation of the total refrigerator unit while having an increased cost because of the individual components of each mechanism.

Hence, a device or mechanism is needed for providing efficient control of refrigerator operation with a lower cost.

BRIEF DESCRIPTION OF THE INVENTION

As described herein, the embodiments of the present invention overcome one or more of the above or other disadvantages known in the art.

One aspect of the present invention relates to a method for managing the operating conditions of a refrigerator unit. The method includes the steps of determining a sensor temperature of a refrigerator unit, determining which of a plurality of disjoint temperatures regions the temperature lies within, and setting an operating condition of each of a plurality of components of said refrigerator unit based on the determined temperature region.

Another aspect of the present invention relates to a device for managing the operating conditions of a refrigerator unit. The device includes a processor in communication with a memory, the memory including code which when accessed by the processor causes the processor to determine a sensor temperature of a refrigerator unit, to determine which of a plurality of disjoint temperatures regions the temperature lies within, and to set an operating condition of each of a plurality of components of the refrigerator unit based on the determined temperature region.

Yet another aspect of the present invention relates to a device for managing operating conditions of a refrigerator unit. The device includes an input means for receiving at least one single-sensor temperature reading, processing means for determining a sensor temperature from at least one single-sensor temperature reading, and determining operating conditions of each of a plurality of components of the refrigerator unit based on said determined temperature, the operating conditions being presented in a plurality of disjoint temperature regions, and output means for outputting said determined operating conditions to each of said plurality of components.

These and other aspects and advantages of the present invention will become apparent from the following detailed description considered n conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

DETAILED DESCRIPTION OF THE EXEMPLARY EMBODIMENTS OF THE INVENTION

Figure 1:
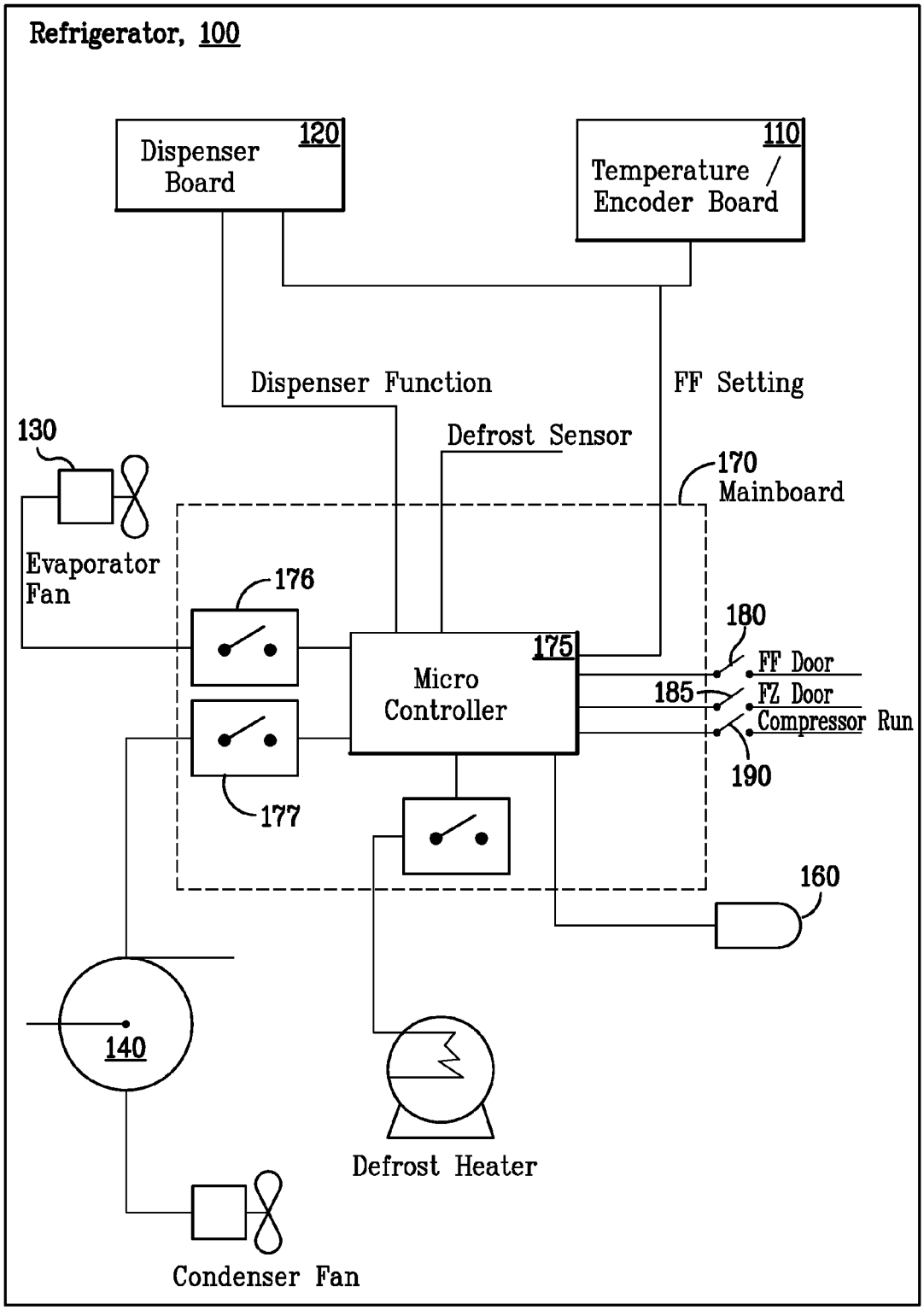
FIG. 1 is a block diagram of an exemplary embodiment of the invention described herein.

FIG. 1 illustrates an exemplary multi-functional system 100 in accordance with the principles of the invention. Processing unit 170, which is composed of microcontroller 175 and is in communication with temperature/encoder board 110, dispenser board 120, evaporator fan 130, compressor 140, defrost heater 150, and switches 180, 185 and 190. Switches 180, 185 and 190 are related to the refrigerator door of the fresh food compartment (FF Door), the refrigerator door of the freezer compartment (FZ Door) and a compressor running indication, respectively.

Microcontroller 175 receives information from temperature/encoder board 110 and provides setting to the temperature encoder/board 110 to maintain the refrigerator unit at a desired temperature. Similarly, microcontroller 175 receives input from dispenser board 120 to dispense water or ice, dependent upon a switch setting (not shown). Microcontroller 175, in response, then provides signals to the dispenser board 120 to allow dispensing of water or ice, as desired. For example, microcontroller 175 may provide a signal to open a water valve when water is to be dispensed.

Microcontroller 175 may further sense and/or control the position of one or more of switches 176, 177, 178, 180, 185 and 190 to manage the operation of the refrigerator in an efficient manner. For example, microcontroller 175 may periodically control switch 178 to allow defrost heater 150 to provide heat to defrost the refrigerator unit (not shown) and/or the freezer unit (not shown). Similarly, microcontroller 175 may periodically control switches 176 and 177 to control evaporator fan 130 and compressor 140, respectively. The period of controlling each switch and the duration the switch is in a first position or a second position is dependent upon the operating conditions of the refrigerator unit. These values may be set at nominal or preset values and adapted based on the operating conditions of the refrigerator unit.

Microcontroller 175 receives a status of switches 180, 185 and 190 and adapts its processing based on the status of these switches. For example, when switch 180, which is associated with refrigerator door, indicates that the refrigerator door is open, dispensing of water or ice may be inhibited. In another example, when switch 185 indicates the freezer door is open, the compressor 140 or defrost heater 150 may be inhibited from being activated.

Microcontroller 175 further receives a temperature input from a temperature sensor such as a thermistor 160. Thermistor 160 monitors and provides information regarding variations in temperature in the fresh food Compartment of the refrigerator unit. In one aspect of the invention, the thermistor 160 may read a temperature in defined periodic intervals. For example, a current temperature may be obtained every 2 minutes by polling the thermistor 160 for its current temperature value. In other aspects of the invention, the period of polling may be greater or less than the exemplary 2-minute value presented herein.

In accordance with the principles of the invention, the integration of the numerous functions within a single microcontroller 175 provides for efficient operation of the overall system.

Figure 2:
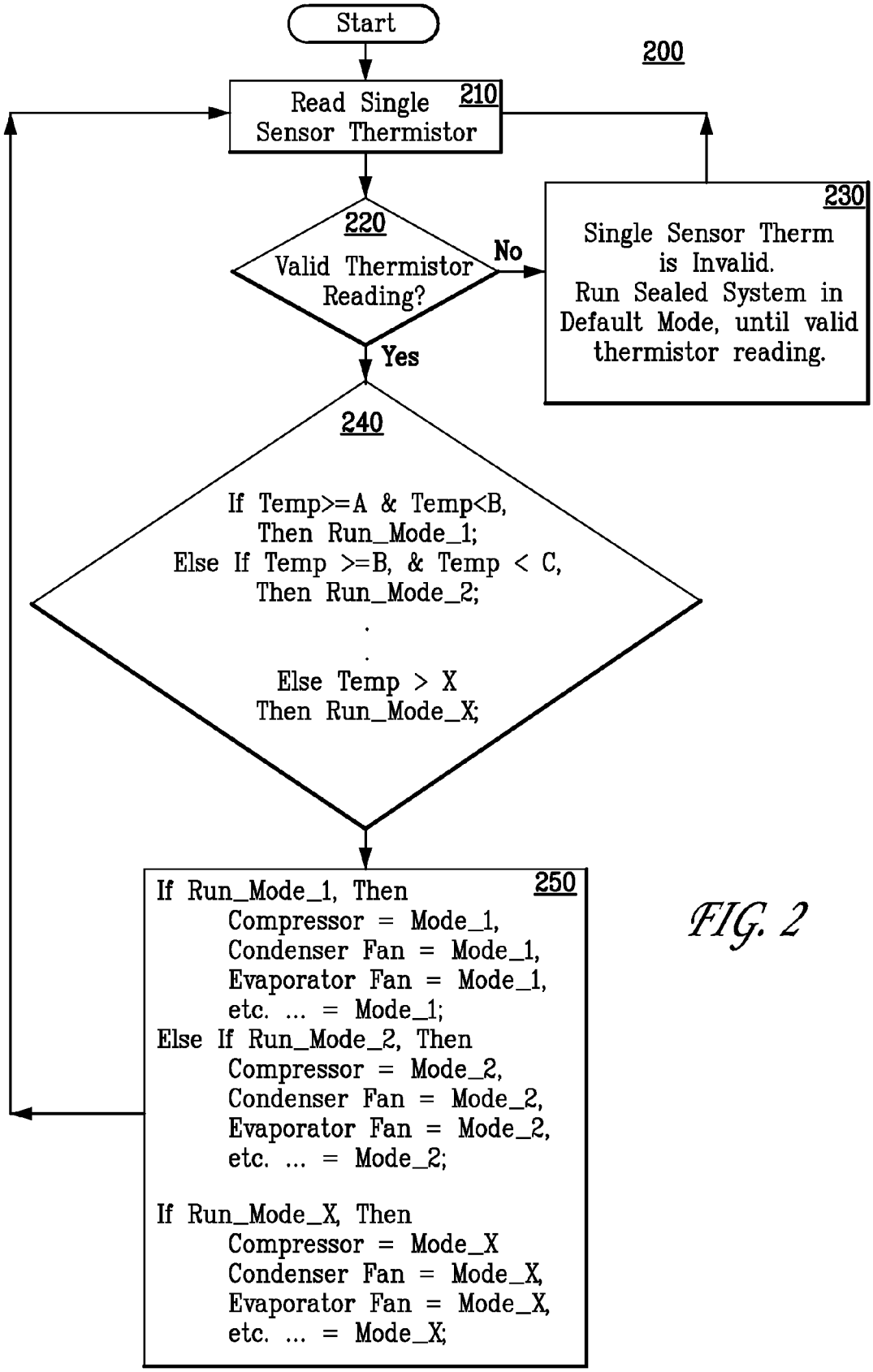
FIG. 2 is a flow chart of an exemplary process of the invention described herein.

FIG. 2 illustrates a flow chart of an exemplary process for managing the operation of the system described herein. In this exemplary process, at block 210, a reading of thermistor 160 is performed. At block 220, a determination is made whether the measured temperature value is valid. If the answer is negative, then processing executes a default process at block 230 and processing returns to block 210. The default process of block 230 represents a fail-safe mode to ensure quality operation of the unit with a failed thermistor. For example, in the event of an invalid thermistor reading, the decision loop will continue to re-check the thermistor 160 for one of a specified number of re-tries, or a specified time period. If a valid reading of the thermistor 160 is not obtained within these parameters, the system will use a default "fall-back" mode to maintain quality operation. The default mode may, in one aspect, set the refrigerator components to a nominal operating condition. As would be recognized, the measured value may be a current measured value or may be a processed value that includes information regarding previously measured values. As will be explained herein, the measured value may, in one aspect of the invention, be an average value of measured values taken over a period of time.

At block 240, a plurality of tests regarding the measured value read from thermistor 160 are performed;

if the measured value (e.g., temperature) is between a first and a second value, then a first mode of operation is selected;

if the measured value (e.g., temperature) is between the second and third values, then a second mode of operation is selected;

if the measured value (e.g., temperature) is between the third and fourth value, then a third mode of operation is selected.

This process is repeated for each of a plurality of disjoint value (e.g., temperature) ranges to determine which of a plurality of modes of operation is to be executed. In one exemplary embodiment of the invention, the refrigerator unit will operate in accordance with the operating conditions shown in Table 1.

Referring to Table 1, when the measured thermistor value is greater than 55 degrees F., the elements of the refrigerator unit operate in one mode, whereas, if the thermistor indicates an operating temperature between 40 degrees and 55 degrees F., then the refrigerator components are operated in a second mode. Similarly, if the operating temperature is between 34 and 40 degrees F., then the refrigerator components are operated in a third mode and when the temperature is below 34 degrees F., the refrigerator components are operated in a fourth mode. Although, the invention is described with regard to four (4) operating temperature ranges, it would be within the knowledge of those skilled in the art to expand or reduce the number of operating ranges and the operating conditions of each of the refrigerator components within each range. In addition, two default ranges (i.e., above 150 degrees F. and below 41 degrees F.) are shown, wherein temperatures within these ranges cause the system to operate with specific default values or operating conditions.

TABLE 1

Exemplary Operating Conditions

| | |
|---|---|
| | Invalid Thermistor Reading<br>Default Settings:<br>i.e. Compressor, Evap, Cond-Med<br>Damper-Open |
| 150 F. | |
| | Compressor-High<br>Evap-High<br>Cond-High<br>Damper-Open |
| 55 F. | |
| | Compressor-Med<br>Evap-Med<br>Cond-Med<br>Damper-Open |
| 40 F. | |
| | Compressor-Low<br>Evap-Low<br>Cond-Low<br>Damper-Open |
| 34 F. | |
| | Compressor-Off<br>Evap-Off<br>Cond-Off<br>Damper-Closed |
| -41 F. | |
| | Invalid Thermistor Reading<br>Default Settings:<br>i.e. Compressor, Evap, Cond-Med<br>Damper-Open |

Referring back to FIG. 2, at block 250, a determined process is executed to place the compressor 140, condenser fan 165, evaporator fan 130 and other elements, which are not shown, in an appropriate mode based on the measured temperature and the characteristics in the corresponding temperature range. For example, in one mode (i.e., between 40 and 55 deg. F.), each of a compressor, evaporator and condenser may operate in a medium condition while a damper may be left open. An in another example, between 34 and 40 deg. F., compressor 140, condenser fan 165, evaporator fan 130 are operated in a low mode and the damper is closed. In one aspect of the invention, the operating characteristics "high," "medium," and "low" may represent operating ranges based on a percentage of a nominal, a desired or a rated setting of the corresponding component. For example, a high condition may represent operation of a component at 100 percent of a nominal or desired or rated operating condition, a medium condition may represent operation of a component in a range of 45 to 55 percent of a nominal or desired or rated operating condition. A low condition may represent operation of a component in a range of 25-35 percent of a nominal or desired or rated operating condition. Conventional refrigerator compressor units operate within a range of 500 to 800 BTU and, hence, the high, medium, and low operating conditions for a refrigerator compressor may be determined based on the compressor rating and the aforementioned exemplary percent ranges. Similarly, typical fans operate in a range of 1000-3000 RPM and hence, the high, medium and low operating conditions may be determined based on the fan rating and the aforementioned exemplary percent ranges. In addition, the percentage ranges may be formulated so that a minimum operating condition for a component exists. By way of example, if the compressor rating is 800 BTU, a low operating condition may be set so that the output of the compressor does not fall below a known value (e.g., 400 BTU). Thus, the aforementioned low percent range referred to above (25-35 percent) may be adjusted to be 50-60 percent to insure that the compressor output does not fall below the known value. The medium percent range would also be similarly adjusted. In addition, the exemplary ranges have be described as being disjoint and non-adjacent. However, it would be within the knowledge of those skilled in the art to adjust the ranges to be disjoint and adjacent. Also from Table 1, it can be seen that default operating conditions may be set when invalid measurement is determined.

Figure 3:
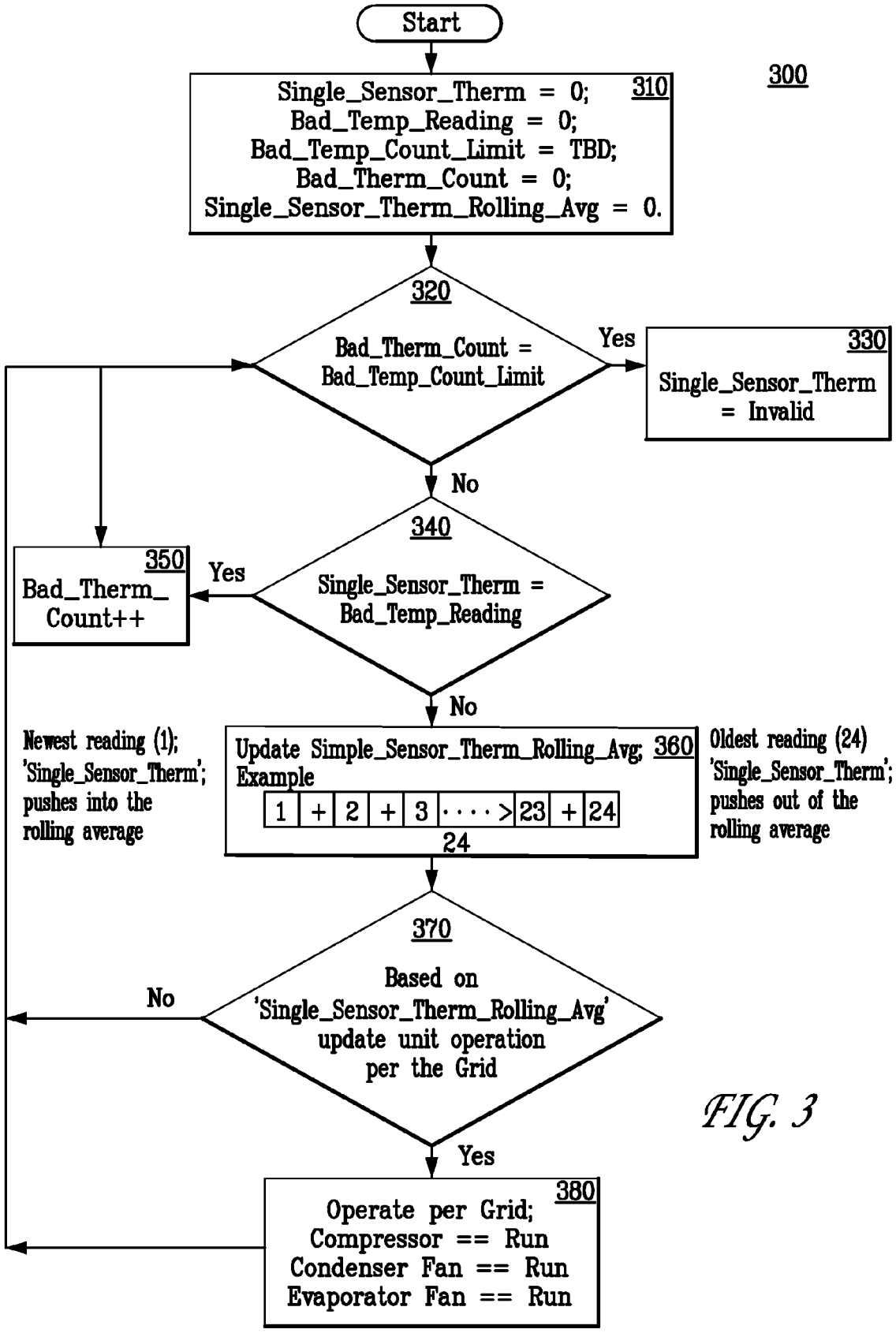
FIG. 3 is a flow chart of a second exemplary process of the invention described herein.

FIG. 3 illustrates a flowchart of an exemplary process 300 for determining a thermistor reading at block 220. In this exemplary process, a plurality of variables and indicators are initialized at block 310. At block 320, a determination is made whether a count of bad temperature readings (Bad_Therm_Count) reaches a predetermined limit. If the answer is affirmative, then the sensor temperature is deemed invalid and processing is ended.

If the answer at block 320 is negative, then a determination is made at block 340 whether a single-sensor reading (i.e., current reading) is not within predetermined limits. If the answer is in the affirmative, then a bad term counter (Bad_Therm_Count) is increased and process continues at block 320. For example, a refrigerator compartment may be expected to be within a range of 32-55 degrees F., and a temperature reading outside this range may be deemed to be a bad temperature reading. However, in case the operation disclosed herein is associated with a freezer compartment, then the freezer compartment may be expected to be within a temperature range of 10-30 degrees and a temperature reading outside this range, for a freezer compartment, may be deemed to be a bad temperature reading. Accordingly, the values shown in Table 1 may be adjusted based on the context of the specific operation and/or unit being monitored.

If the answer at block 340 is negative (i.e., the temperature reading is within predetermined limits), then the temperature reading, in this illustrated aspect of the invention, is processed such that a known number of single sensor readings are accumulated and a rolling average of the number of sensor readings is performed at block 360. In the illustrated example, 24 readings are averaged together in a rolling average. However, it would be recognized that this number may be increased or decreased without altering the scope of the invention. As is known in the art, a rolling average is performed by taking a number of readings over a known period of time. Older values are then removed as new values are added to the period of time. At block 370, a determination is made whether the rolling average value is within the values shown in Table 1 (which may be referred to as a temperature grid). If the answer is negative, then processing continues at block 320.

However, if the answer is in the affirmative, then the compressor 140, the condenser fan 165 and the evaporator fan 130 are set to a run condition based on the conditions defined in the grid entry corresponding to the determined rolling average value. Processing then returns to block 320 to continue monitoring the temperature value.

As noted above, a Bad_Therm_Count is maintained and monitored. The Bad_Therm_Count is a variable value of a number of consecutive attempts of reading the thermistor 160 before a valid temperature reading is achieved. In one exemplary embodiment of the invention, the thermistor read value may be checked for "n" consecutive times to insure it is an invalid reading, and it wasn't just a single bad reading. The number of checks "n" may be determined based on the periodic sample rate (i.e., polling rate) and a desired time before indicating a failure has occurred. The term "Single_Sensor_Therm" refers to the current reading of the thermistor. The Single_Sensor_Therm value is then accumulated, averaged and stored as "single_sensor_therm_rolling_avg." "Single_sensor_therm_rolling_avg" may be used as the sensor temperature in step 240 (FIG. 2). A rolling average, as is known in the art, provides for the accumulation and use of a fixed number of values in determining an average value and then removal of an oldest value when a new value is obtained. The use of a rolling average is advantageous in that the system doesn't change state drastically with each new thermistor reading. An example of a rapid change in temperature may occur when a refrigerator fresh food compartment door is left open allowing a rush of warm air into the refrigerator compartment. This rapid change in temperature may instantaneously change the thermistor reading, but the effect of this change is filtered by the previously accumulated values. In one aspect of the invention, a rolling average of approximately 24 previous readings is maintained to filter out instantaneous changes, and keep smooth operation of the unit.

Although not shown, it would be appreciated that the polling rates described herein may dynamically be adapted based on the one or more criteria. For example, while a polling rate of 2 minutes is described above to determine a obtain a measure value, the polling rate may dynamically be altered in the case of invalid individual reading or after the determination of "n" number of invalid readings. In addition, while FIGS. 2 and 3 appear to operate sequentially (i.e., a temperature reading at block 240 invokes the processing of FIG. 3), it would be appreciated that the processing shown in FIG. 3 may operate at one level and the processing shown in FIG. 2 may operate at a second level. For example, the polling of the thermistor 160 to obtain current temperature readings (FIG. 3) may be performed at a high rate (e.g., every 0.5 seconds), and the processing of determining the operating mode (FIG. 2) may be performed at a lower rate (e.g., 2 seconds). The processing of FIG. 2 may access the rolling average value determined in FIG. 3. In another aspect of the invention, the processing at block 240 may be performed, serially, by the processing shown in FIG. 3.

The above-described methods according to the preferred embodiment of invention shown herein can be realized in hardware or as software or computer code that can be stored in a recording medium such as a CD ROM, an RAM, a floppy disk, a hard disk, or a magneto-optical disk or downloaded over a network, so that the methods described herein can be rendered in such software using a general purpose computer, or a special processor or in programmable or dedicated hardware, such as an ASIC or FPGA. As would be understood in the art, the computer, the processor or the programmable hardware include memory components, e.g., RAM, ROM, Flash, etc. that may store or receive software or computer code that when accessed and executed by the computer, processor or hardware implement the processing methods described herein.

Figure 4:
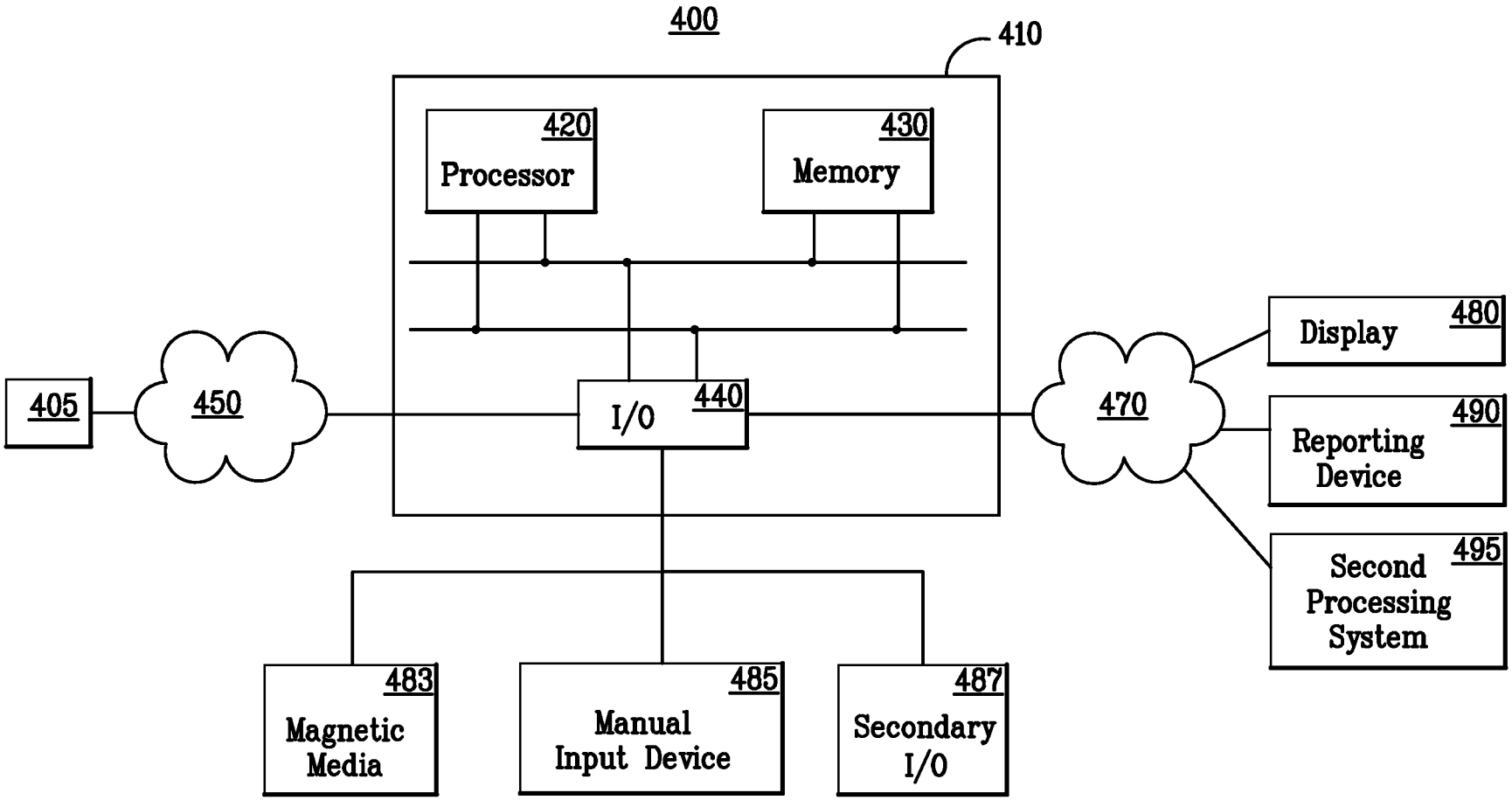
FIG. 4 is a system for implementing the processing shown in FIGS. 2 and 3.

FIG. 4 illustrates a system 400 for implementing the principles of the invention shown herein. In this exemplary system embodiment 400, input data is received from sources 405 over network 450 and is processed in accordance with one or more programs, either software or firmware, executed by processing system 410. The results of processing system 410 may then be transmitted over network 470 for viewing on display 480, reporting device 490 and/or a second processing system 495.

Processing system 410 includes one or more input/output devices 440 that receive data from the illustrated sources or devices 405 over network 450. The received data is then applied to processor 420, which is in communication with input/output device 440 and memory 430. Input/output devices 440, processor 420 and memory 430 may communicate over a communication medium 425. Communication medium 425 may represent a communication network, e.g., ISA, PCI, PCMCIA bus, one or more internal connections of a circuit, circuit card or other device, as well as portions and combinations of these and other communication media.

Processing system 410 and/or processor 420 may be representative of a handheld calculator, special purpose or general purpose processing system, desktop computer, laptop computer, palm computer, or personal digital assistant (PDA) device, etc., as well as portions or combinations of these and other devices that can perform the operations illustrated.

Processor 420 may be a central processing unit (CPU) or dedicated hardware/software, such as a PAL, ASIC, FGPA, operable to execute computer instruction code or a combination of code and logical operations. In one embodiment, processor 420 may include code which, when executed by the processor, performs the operations illustrated herein. The code may be contained in memory 430, may be read or downloaded from a memory medium such as a CD-ROM or floppy disk, represented as 483, may be provided by a manual input device 485, such as a keyboard or a keypad entry, or may be read from a magnetic or optical medium (not shown) or via a second I/O device 487 when needed. Information items provided by devices 483, 485, 487 may be accessible to processor 420 through input/output device 440, as shown. Further, the data received by input/output device 440 may be immediately accessible by processor 420 or may be stored in memory 430. Processor 420 may further provide the results of the processing to display 480, recording device 490 or a second processing unit 495.

As one skilled in the art would recognize, the terms processor, processing system, computer or computer system may represent one or more processing units in communication with one or more memory units and other devices, e.g., peripherals, connected electronically to and communicating with the at least one processing unit. Furthermore, the devices illustrated may be electronically connected to the one or more processing units via internal busses, e.g., serial, parallel, ISA bus, Micro Channel bus, PCI bus, PCMCIA bus, USB, etc., or one or more internal connections of a circuit, circuit card or other device, as well as portions and combinations of these and other communication media, or an external network, e.g., the Internet and Intranet. In other embodiments, hardware circuitry may be used in place of, or in combination with, software instructions to implement the invention. For example, the elements illustrated herein may also be implemented as discrete hardware elements or may be integrated into a single unit.

As would be understood, the operations illustrated may be performed sequentially or in parallel using different processors to determine specific values. Processing system 410 may also be in two-way communication with each of the sources 405. Processing system 410 may further receive or transmit data over one or more network connections from a server or servers over, e.g., a global computer communications network such as the Internet, Intranet, a wide area network (WAN), a metropolitan area network (MAN), a local area network (LAN), a terrestrial broadcast system, a cable network, a satellite network, a wireless network, or a telephone network (POTS), as well as portions or combinations of these and other types of networks. As will be appreciated, networks 450 and 470 may also be internal networks or one or more internal connections of a circuit, circuit card or other device, as well as portions and combinations of these and other communication media or an external network, e.g., the Internet and Intranet.

While there has been shown, described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for managing the operating conditions of a refrigerator unit, comprising the steps of:

determining a sensor temperature of the refrigerator unit, comprising:

obtaining at least one single-sensor temperature reading;

determining whether said at least one single-sensor temperature reading is valid;

accumulating a known number of said valid single-sensor temperature readings;

obtaining at least one additional single-sensor temperature reading when one of said at least one single-sensor temperature readings is determined to be invalid;

accumulating a count of said determined invalid single-sensor temperature readings; and determining said sensor temperature as invalid when said accumulated count of said determined invalid single-sensor temperature readings exceeds a predetermined value;

determining which of a plurality of disjoint temperature regions said sensor temperature lies within; and setting an operating condition of each of a plurality of components of the refrigerator unit based on conditions associated with said determined temperature region to a default value when said sensor temperature is determined to be invalid.

2. The method of claim 1, wherein said accumulating of said known number of said valid single-sensor temperature readings comprises averaging said known number of valid single-sensor temperature readings.

3. The method of claim 1, wherein said single-sensor temperature readings are valid when said single-sensor temperature reading is within a region in the order of −41 to 150 degrees F.

4. The method of claim 1, wherein said sensor temperature is determined periodically.

5. The method of claim 1, wherein each of said disjoint temperature regions has associated therewith an operating condition of at least one of a refrigerator compressor unit, an evaporator unit, a condenser unit and a damper unit.

6. The method of claim 1, wherein said one additional single-sensor temperature reading is obtained at a known periodic rate.

7. The method of claim 1, wherein at least one of said plurality of disjoint regions includes at least default operational settings for each of a refrigerator compressor unit, an evaporator unit, a condenser unit and a damper unit.

8. A device for managing the operating conditions of a refrigerator unit, comprising:

a processor in communication with a memory, the memory including code which when accessed by said processor causes said processor to:

determine a sensor temperature of the refrigerator unit, comprising:

obtaining at least one single-sensor temperature reading;

determining whether said at least one single-sensor temperature reading is valid;

accumulating a known number of said valid single-sensor temperature readings;

obtaining at least one additional single-sensor temperature reading when one of said at least one single-sensor temperature readings is determined to be invalid;

accumulating a count of said determined invalid single-sensor temperature readings; and determining said sensor temperature as invalid when said accumulated count of said determined invalid single-sensor temperature readings exceeds a predetermined value;

determine which of a plurality of disjoint temperature regions said temperature lies within; and set an operating condition of each of a plurality of components of the refrigerator unit based on conditions associated with said determined temperature region to a default value when said sensor temperature is determined to be invalid.

9. The device of claim 8, wherein said accumulating of said known number of said valid single-sensor temperature readings comprises averaging said known number of valid single-sensor temperature readings.

10. The device of claim 8, wherein said single-sensor temperature readings are valid when said single-sensor temperature reading is within a region in the order of −41 to 150 degrees F.

11. The device of claim 8, wherein said sensor temperature is determined periodically.

12. The device of claim 8, wherein said disjoint temperature regions have associated therewith an operating condition of at least one of a refrigerator compressor unit, an evaporator unit, a condenser unit and a damper unit.

13. The device of claim 8, wherein said one additional single-sensor temperature is obtained at a known periodic rate.

14. The device of claim 8, wherein at least one of said plurality of disjoint regions includes at least default operational settings for each of a refrigerator compressor unit, an evaporator unit, a condenser unit and a damper unit.

15. The device of claim 8, further comprising:

at least one input/output device in communication with said processor and said memory.

16. A device for managing operating conditions of a refrigerator unit, comprising:

an input means for receiving at least one single-sensor temperature reading;

processing means for determining a sensor temperature from at least one single-sensor temperature reading, comprising:

determining whether said at least one single-sensor temperature reading is valid; and accumulating a known number of said valid single-sensor temperature readings; and obtaining at least one additional single-sensor temperature reading when one of said at least one single-sensor temperature reading is determined to be invalid;

accumulating a count of said determined invalid single-sensor temperature readings;

determining said sensor temperature as invalid when said accumulated count of said determined invalid single-sensor temperature readings exceeds a predetermined value; and determining operating conditions of each of a plurality of components of the refrigerator unit based on said sensor temperature, wherein said operating conditions are presented for a plurality of disjoint temperature regions, and further including default conditions when said sensor temperature is determined to be invalid; and output means for outputting said determined operating conditions to each of said plurality of components.

17. The device of claim 16, wherein said accumulating of said known number of said valid single-sensor temperature readings comprises averaging said known number of valid single-sensor temperature readings.

18. The device of claim 16, wherein said single-sensor temperature readings are valid when said single-sensor temperature reading is within a region in the order of −41 to 150 degrees F.

* * * * *